United States Patent [19]

Schwarz et al.

[11] 4,350,878

[45] Sep. 21, 1982

[54] CONCEPTION CONTROL CALENDAR

[76] Inventors: Karl H. Schwarz; Ingrid Schwarz, both of Urb. La Sirena No. 77, Benajarafe, Spain

[21] Appl. No.: 264,683

[22] Filed: May 18, 1981

[51] Int. Cl.[3] ..... G06C 3/00

[52] U.S. Cl. ..... 235/78 RC; 235/88 RC

[58] Field of Search ..... 235/78 R–78 RC, 235/85 R–89 R

[56] References Cited

U.S. PATENT DOCUMENTS

| | | | |
|---|---|---|---|
| 2,476,408 | 7/1949 | Fisher | 235/78 RC |
| 2,493,792 | 1/1950 | Walmsley | 235/88 RC |
| 2,512,915 | 6/1950 | Boutwell | 235/88 RC |
| 2,542,943 | 2/1951 | Reiner | 235/88 RC |
| 2,615,631 | 10/1952 | Sorrels | 235/88 RC |
| 2,638,272 | 5/1953 | Heck | 235/88 RC |
| 2,725,195 | 11/1955 | Rueff | 235/88 RC |
| 2,727,686 | 12/1955 | Thalmann | 235/88 RC |
| 2,793,809 | 5/1957 | Crowe | 235/88 RC |
| 2,808,206 | 10/1957 | Gomez-Rodriguez | 235/88 RC |
| 3,215,344 | 11/1957 | Joffe | 235/78 RC |
| 3,486,691 | 12/1969 | Rodriguez | 235/88 RC |
| 3,964,674 | 6/1976 | Van der Gaast | 235/88 RC |

*Primary Examiner*—Richard A. Wintercorn
*Assistant Examiner*—Benjamin R. Fuller
*Attorney, Agent, or Firm*—Fishburn, Gold and Litman

[57] ABSTRACT

A calculating device is provided to aid in predicting the periods of fertility and non-fertility during a menstrual cycle of a user. The device includes a first disc having indicia thereon representing the calender days of the present month and the next month, a second disc having indicia thereon indicating the length of and the days in a normal menstrual cycle of the user, and a base plate having markers thereon which, when placed in proper registry with the indicia on the two discs, indicate which calendar days during the present menstrual cycle the user is fertile. In a second embodiment an additional disc is provided for indicating days in the shortest period of a user who has irregular menstrual cycles. This additional disc, when placed in registry with the other discs, indicates an expanded period of fertility for the user.

10 Claims, 9 Drawing Figures

Fig. 6.
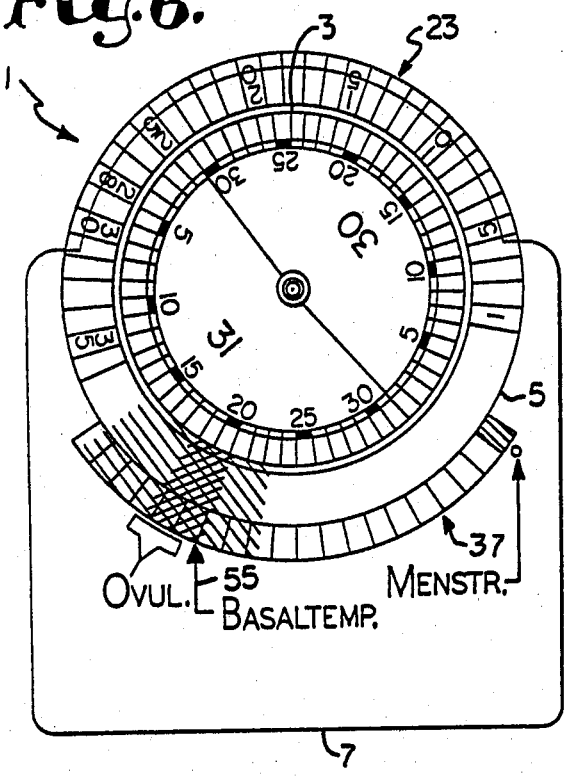
Fig. 8.
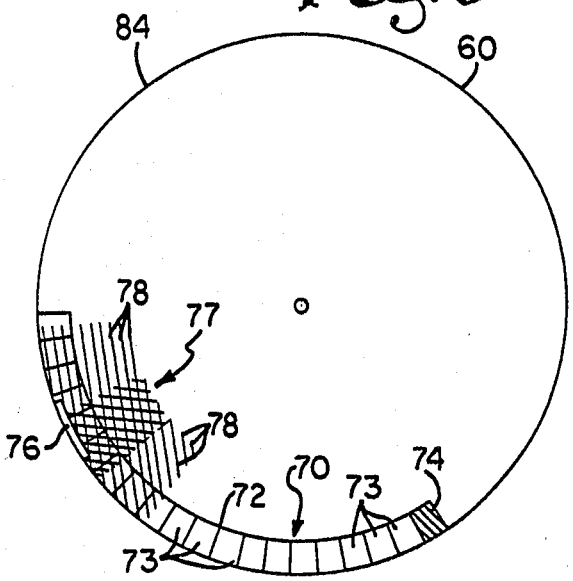
Fig. 7.
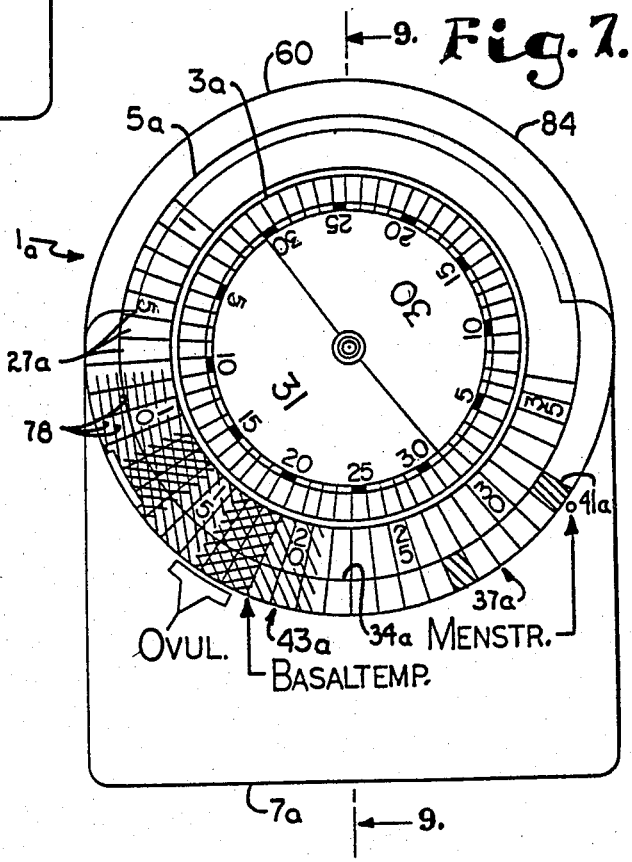
Fig. 5.
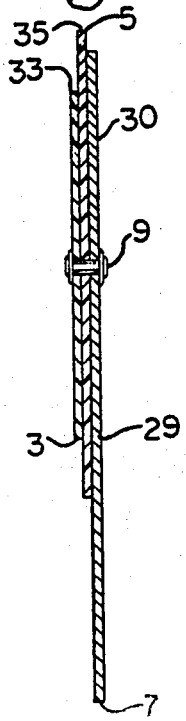
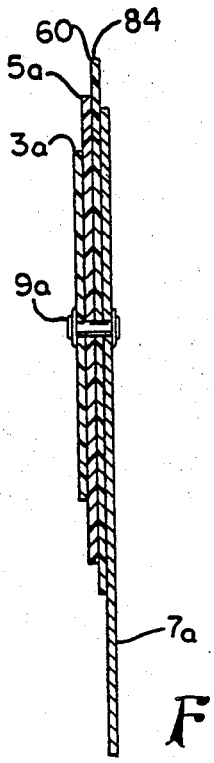
Fig. 9.

CONCEPTION CONTROL CALENDAR

BACKGROUND OF THE INVENTION

This invention relates to calendar calculating devices and in particular to such devices which aid a female user to ascertain the days of fertility in her present menstrual cycle.

It is well known that a female is susceptible to impregnation during only a portion of her menstrual cycle. Specifically, the normal female is capable of being impregnated by sexual intercourse only when such intercourse occurs during that portion of the menstrual cycle that is near in time to ovulation.

It has been found that ovulation occurs between the fourteenth to sixteenth day prior to the beginning of the female's next menstrual cycle. This is true even for females having menstrual cycles which are irregular in length. Further, it is known that the life expectancy of an ovum is approximately one day and the life expectancy of the male sperm is approximately two days. Therefore, after allowing a day before and two days after ovulation, a female is fertile or capable of being impregnated during a period extending from the eleventh to the nineteenth day prior to the beginning of her next menstrual cycle. By knowing when a present menstrual cycle of a female is to end, it is possible to ascertain the days of fertility during the menstrual cycle. A problem occurs in that, although a normal menstrual cycle is reckoned to be a constant twenty-eight days, many females have a regular menstrual cycle of a constant length other than twenty-eight days and still others have menstrual cycles of irregular length; for example, a certain cycle of a woman may be twenty-four days whereas the next cycle may be thirty-two days.

Prior examples of such calculating devices for the woman to utilize herself have proven to be ineffective or unacceptable for various reasons. Some of the prior devices have not had the capability of enabling females who have menstrual cycles which are not a constant twenty-eight days in length to predict or ascertain their potential period of fertility. Still other examples of the prior art have been cumbersome and complicated to understand thereby decreasing their effectiveness to a user. In addition, prior art devices normally fail to function if a user's period is irregular in nature.

OBJECTS OF THE INVENTION

Therefore, the objects of the present invention are: to provide a conception control calendar which will indicate to a user the calendar days of fertility in a present menstrual cycle; to provide such a calendar which comprises a calendar day scale, a menstrual cycle day scale, and a base plate having markers thereon which when placed in proper registry with the calendar day scale and menstrual cycle day scale indicate to a user her fertile days; to provide such a calendar day scale which includes indicia thereon representing the calendar days of two consecutive months, one having thirty days and one having thirty-one days; to further provide such a conception control calendar which can be used by women who have a menstrual cycle which is irregular, that is not constant in length; to provide such a calendar for women having menstrual cycles of irregular length which includes an additional scale which, when placed in proper registry on the calendar, will indicate to a user the potential days of fertility during her present menstrual cycle; to further provide such a calendar which will indicate the calendar day to a user upon which her next menstrual period begins; to further provide such a calendar which includes indicia thereon which indicate to a user, who measures her body temperatures throughout a menstrual cycle, the days of fertility after her body reaches a basal temperature; to further provide such a calendar which is simple in design and which is easy to understand and operate; and to provide such a calendar which is easy to manufacture, durable in use and particularly well adapted for the intended usage thereof.

Other objects and advantages of this invention will become apparent from the following description taken in connection with the accompanying drawings wherein are set forth, by way of illustration and example, certain embodiments of this invention.

SUMMARY OF THE INVENTION

A conception control calendar is provided which comprises: a calendar day scale having indicia thereon representing the calendar days of two months, preferably a thirty day month and a thirty-one day month; a menstrual cycle scale having indicia thereon representing the days of a normal menstrual cycle of a user; and a base plate having markers thereon which, when placed in proper registry with the day scale and menstrual cycle scale, indicate the days of fertility in the present menstrual cycle of a user.

The calendar day scale comprises a disc divided into two sections, each section having annular segments of generally equal arc placed therearound with the segments of one section being numbered consecutively from one to thirty and the segments of the other section numbered from one to thirty-one thereby representing the calendar days of two months. The menstrual cycle scale comprises a disc made of at least partially transparent material having a plurality of annular segments around a circumferential portion thereof, each segment subtending an inner angle equal to the angle subtended by each of the annular segments on the calendar day scale. The menstrual cycle scale segments are numbered to indicate the days of a menstrual cycle of a user. The calendar day scale and the menstrual cycle scale are concentrically attached to the base plate by suitable means to allow the two scales to rotate relative to each other and to the base plate. The base plate includes an arcuate section concentric with the discs having a plurality of annular segments each of which subtend an inner angle equal to the inner angle of the segments of the calendar disc and menstrual cycle disc. The base plate further has indicia thereon which, when the two discs and base plate are rotated in proper registry, indicate upon the calendar scale by color or shading which is visual therethrough, the days of the month in which the user is fertile.

In an alternate embodiment an additional disc is provided to enable the calendar to be used by a woman who has irregular menstrual cycles of irregular length. The additional disc includes an arcuate section substantially similar to the base plate arcuate section having a plurality of segments thereon with indicia thereon to indicate possible days of fertility. When the additional disc is placed in proper registry with the calendar day scale and menstrual day scale an expanded period of possible fertility is indicated on the calendar day scale.

The drawings constitute a part of this specification and include exemplary embodiments of the present invention and illustrate various objects and features thereof.

BRIEF DESCRIPTION OF THE DRAWINGS

FIG. 5 is a cross-sectional view of the conception control calendar showing the calendar taken along line 5—5 in FIG. 1.

FIG. 6 is a top plan view of the conception control calendar showing the calendar in an alternative use.

FIG. 7 is a top plan view of an alternate embodiment of the conception control calendar including an auxiliary menstrual cycle disc for use with women having irregular menstrual cycles.

FIG. 8 is a top plan view of the auxiliary menstrual cycle disc of the conception control calendar shown in FIG. 7.

FIG. 9 is a cross-sectional view of the alternate embodiment of the conception control calendar taken along line 9—9 of FIG. 7.

DETAILED DESCRIPTION OF THE PREFERRED EMBODIMENT

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
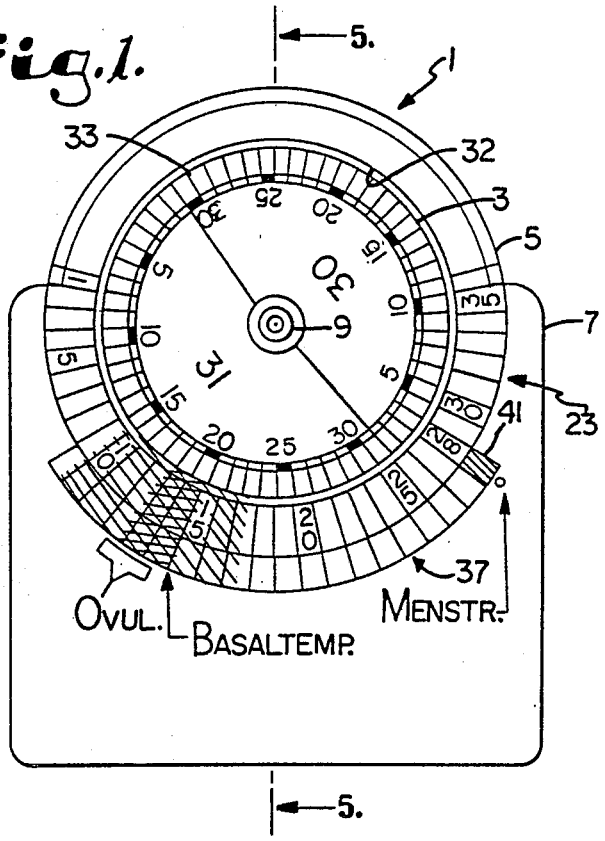
FIG. 1 is a top plan view showing a conception control calendar according to the present invention having a calendar day disc, a menstrual cycle day disc, and a base plate.

The reference numeral 1 in FIGS. 1 through 6 generally designates a conception control calendar according to the present invention. The calendar consists of an upper calendar day scale 3, a lower menstrual cycle scale 5 and a base plate 7. As shown in FIG. 1 in the present embodiment example, the calendar day scale 3 and the menstrual cycle scale 5 comprise discs which are retained concentrically on the base plate 7 by means of a suitable retainer which allows the calendar day scale 3 and menstrual scale 5 to resistively rotate relative to one another and to the base plate 7 when urged by the hands of a user. In the present embodiment, the retainer used is a hollow rivet 9. Sufficient resistance is provided between the day scale 3, menstrual scale 5 and rivet 9 to maintain relative positions thereof when no manual force is applied thereto.

Figure 4:
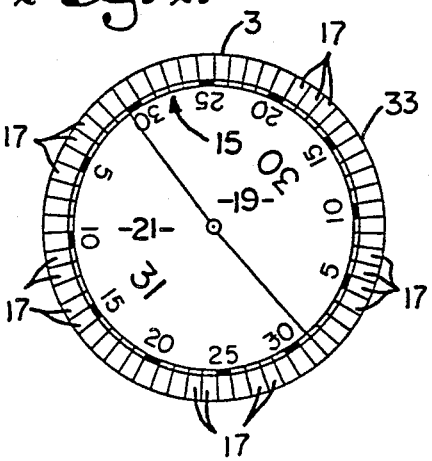
FIG. 4 is a top plan view of the calendar day scale of the conception control calendar.

As shown in FIG. 4, the calendar day scale 3 includes a plurality of arcuate segments 17 about an outer circumferential periphery 15 thereof, each segment 17 subtending a generally equal inner angle and having annularly spaced inner and outer walls. The segments 17 represent the calendar days of two successive months. As shown, the calendar day scale 3 is divided into two parts, a first part 19 having thirty arcuate segments representing the days in a calendar month having thirty days, and a second part 21 having thirty-one arcuate segments representing the calendar days of a month having thirty-one days.

Figure 3:
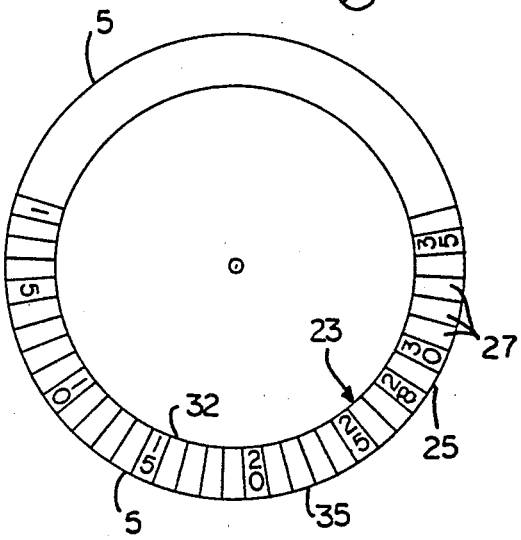
FIG. 3 is a top plan view of the menstrual cycle day scale of the conception control calendar.

As shown in FIG. 3, the menstrual cycle scale disc 5 includes an arcuate segmented portion 23 partially around an outer periphery 25 thereof, having a plurality of arcuate segments 27, each of which subtends an equal inner angle and has annularly spaced inner and outer walls. Further, the menstrual cycle disc segments 27 subtend an angle equal to that subtended by the arcuate segments 17 of the calendar day scale disc 3. The menstrual cycle scale annular segments 27 are numbered to indicate the days in a present menstrual cycle of a user. As shown, the segments are numbered consecutively from 1 to approximately 35 including a segment numbered 28 indicating a menstrual cycle having a length of twenty-eight days which is reckoned as a normal length of a menstrual cycle of a human female.

Figure 2:
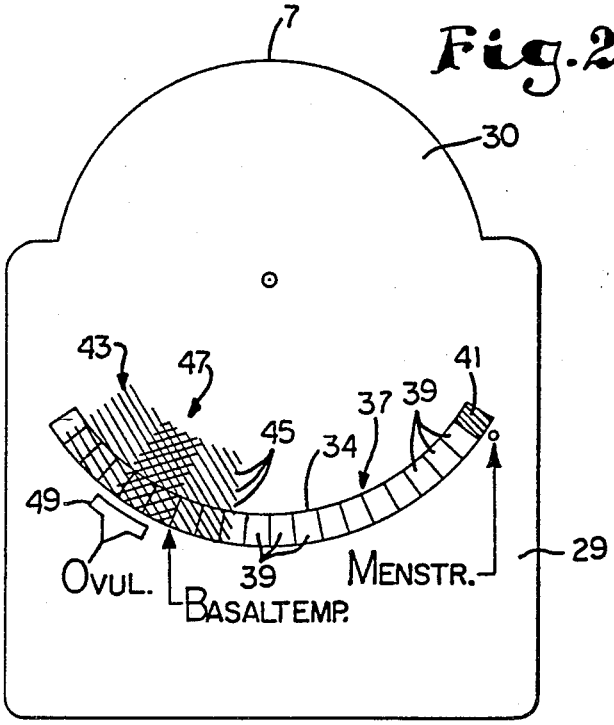
FIG. 2 is a top plan view of the base plate of the conception control calendar.

In the illustrated embodiment as shown in FIG. 2, the base plate 7 has a lower portion 29 and top portion 30. The top portion 30 is substantially semicircular and has the calendar scale 3 and the menstrual cycle scale 5 concentrically attached therewith in overlapping relationship in that ascending order. The radius of the top portion 30 is less than that of the menstrual cycle scale 5 so that both the calendar scale 3 and menstrual cycle scale 5 can be easily manipulated by a user.

The base plate lower portion 29 is slightly wider than the diameter of the menstrual cycle scale 5 and is easily held by a user so that the various scales can be conveniently manipulated, thereby reducing the possibility of miscalculations.

The base plate 7 further includes an arcuate section 37 in the lower portion 29 thereof which is substantially concentric with the menstrual cycle disc 5. The arcuate section 37 is divided into a plurality of segments 39, each such segment subtending a generally central angle, and as shown in FIG. 1, the base plate arcuate segments 39 subtend an angle generally equal to that inner angle associated with both the segments 27 and segments 17. As shown in FIG. 2, an end segment 41 includes indicia such as coloring, shading, or the like and which operably is associated with and thereby indicates a segment on the calendar disc 3 representing the day the next menstrual cycle of the user begins. Further, a fertility indicating field or zone 43, represented by diagonal lines 45, is marked on the base plate 7 and can be visually seen through clear portions of the calendar disc 3 so as to operably indicate on such calendar disc the possible days of fertility in the present menstrual cycle of the user. A cross hatched ovulation area or zone indicated at 47 by marker 49, operably indicates on the calendar disc 3 the days during which ovulation should occur during the present menstrual cycle of a user.

It is seen that the fertility field 43 extends from the eleventh to the nineteenth segments from the noted end segment 41, inclusive. Further, the ovulation field 47 extends from the fourteenth to the sixteenth segment from the end segment 41, inclusive.

As shown in FIG. 1, the menstrual cycle scale 5 has a larger diameter than the calendar scale 3 and specifically, a combined inner boundary 32 defined by the inner boundary of each of the menstrual scale segments 27 is substantially concentric with an edge 33 of the calendar scale 3. Further, an inner edge 34 defined by the inner edges of each of the base plate sections 37 taken in combination is substantially concentric with an edge 35 of the menstrual cycle scale 5. As such, it is convenient for a user to quickly recognize which of the annular segments of the various scales are in registry.

In use, a user having a regular menstrual cycle of a certain length would place the the numbered arcuate segment of the menstrual cycle disc 5 corresponding to that length in registry with the base plate end annular segment 41. Then the user would rotate the calendar day disc 3 relative to base plate 7, while holding the menstrual cycle disc 5 stationary relative to the base plate 7, such that the particular segment 17 on the calendar day disc 3 representing the day the next menstrual cycle of the user begins is also placed in registry with the base plate end segment 41. Upon doing so, each of the segments 17 of the calendar disc 3 which are in registry with the fertility zone 43 on the base plate are those days during the present menstrual cycle of the user in which the user would most probably be fertile to the exclusion of the remaining days of the cycle. Further, the segments 17 of the calendar disc 3 which are in registry with cross hatched area 47 of the base plate are the days during the present menstrual cycle of the user during which ovulation should occur.

If a user cannot ascertain the calendar day upon which the next menstrual cycle should begin, the user may place the particular segment of the menstrual cycle disc segments 27 numbered 1 in a sequence of such segments from 1 to 36 in registry with the particular segment of the calendar disc segments 17 which indicates the day the present menstrual cycle of the user began. Then the user would rotate both discs 3 and 5 simultaneously until the particular segment of the menstrual cycle disc segments 27 indicating one day longer than the length of the regular menstrual cycle of the user is in registry with the end segment 41 of the base plate 7. The segments 17 of the calendar disc 3 in registry with base plate fertility zone 43, indicate those days to the exclusion of the remaining days in the present menstrual cycle of the user during which the user is likely to be fertile or is capable of being impregnated.

It is noted that there are two occurrences in the calendar year where a month having thirty-one days is followed by another month having thirty-one days; in particular, December-January and July-August. It is possible for a user having a regular menstrual cycle of a length greater than thirty-one days to receive an inaccurate reading as to the day the next menstrual cycle of the user will begin. For example, a situation could arise wherein a regular menstrual cycle of a user of a length of 34 days starts on the thirty-first of December (or July). In calculating the calendar days of fertility using the aforementioned steps, it would be ascertained that the days of possible fertility would be from the sixteenth to the twenty third of January (or August). The problem arises in that the day indicated for the beginning of the next cycle of a user would be the fourth day of February (or September). This would be incorrect because the menstrual cycle would extend through the entire month of January (or August) which has thirty-one days but which is represented on the calendar scale 3 as having only 30 days. Therefore, the day the next menstrual cycle would begin should be corrected to the third day of February (or September) when a user having such a period length encounters one of these occurrences.

It is further known in the medical profession, that the body temperature of a female rises slightly within one or two days after ovulation. If a user of the conception control calendar 1 regularly checks her body temperature with a precise thermometer before rising in the morning and notes when the body temperature rises, aside from ill health, the user can use the conception control calendar to predict the remaining fertile days of the present menstrual cycle of the user. In order to use this feature, the user first rotates the menstrual cycle disc 5 such that the segmented portion 23 thereof is placed substantially opposite arcuate section 37 of the base plate 7 as shown in FIG. 6, that is, such that none of the base plate segments 39 are in registry with the menstrual cycle disc segments 27. The user would then place the particular segment of the calendar disc segments 17 corresponding to the day of the month of her temperature rise in registry with the particular segment which is the fourteenth base plate segment 39 from the end segment 41. The day disc segments 17 which are in registry with the fertile zone 43 indicate the remaining days of the present menstrual cycle that the user is fertile.

It is well known that a significant number of females have successive menstrual cycles of varying lengths and therefore have irregular cycles. To allow such a female to predict the potential period of fertility in a present menstrual cycle, a conception control calendar 1*a* representing an alternative embodiment of the present invention, as shown in FIGS. 7 through 9, is provided.

Various elements of the calendar 1*a* as shown in FIGS. 7 through 9, are similar with the calendar 1 of the previous embodiment, as shown in FIGS. 1 through 6. Therefore, similar elements will be referred to as having the same reference numeral with the letter "a" affixed to those elements associated with calendar 1*a*.

The conception control calendar 1*a* includes a calendar disc 3*a*, first menstrual cycle disc 5*a*, a base plate 7*a*, and a second menstrual cycle disc 60. The calendar disc 3*a*, first menstrual disc 5*a*, and second menstrual disc 60 are concentrically retained on the base plate 7*a* by means of a suitable fastener such as a hollow rivet 9*a* or the like. The calendar disc 3*a*, menstrual disc 5*a* and base plate 7*a* are identical to those used in the previous embodiment and in manufacture are interchangeable with the calendar scale 3, menstrual cycle scale 5 and base plate 7. The second menstrual disc 60, FIG. 8, includes at an outer circumferential periphery thereof 70, an arcuate segmented portion 72 having a plurality of segments 73 including an end segment 74 having suitable indicia thereon such as coloring or the like. The segments 73 of the additional menstrual cycle disc 60 are similar in function to those of the base plate 7*a*. A zone or period of fertility 77 indicated by diagonal lines 78 or the like and extending from the eleventh to nineteenth segment from the end segment 74, noninclusive, is included thereon as is an ovulation marker 76 which extends between the fourteenth and sixteenth segments from the end segment 74 non inclusive.

In the configuration of the calendar 1*a*, as shown in FIG. 9, it is preferable that the second menstrual disc 60 be fabricated of a transparent material since the second menstrual disc 60 overlies the various markers and zones on the base plate 7*a*. It is envisioned that a base plate arcuate portion 37*a* could be of greater radius than the disc 60 and positioned on the base plate 7*a* so that an inner edge thereof 34*a* would be positioned radially outward from an outer edge 84 of the second menstrual cycle disc 60. This would allow the second menstrual cycle disc 60 to be fabricated of a nontransparent material.

In use, the user positions the additional menstrual cycle disc 60 such that the fertility zone 77 thereon is overlying the fertility zone 43*a* of the base plate 70. The user then rotates the first menstrual cycle disc 5*a* such that a particular segment 27*a* of the menstrual cycles disc segments which corresponds to the number of days of the shortest menstrual cycle of the user is in registry with the second menstrual cycle disc end segment 74. The user then rotates the calendar day disc 3*a* to where a particular arcuate segment of the calendar day disc segments 17*a* which represents the day after the day the present menstrual cycle began is adjacent the segment 27*a* of the menstrual cycle disc 5*a* which is numbered 1 in a sequence from 1 to 36. The user then rotates simultaneously the calendar disc 3*a*, the menstrual cycle disc 5*a* and the second menstrual cycle disc 60 such that a particular segment of the menstrual cycle disc segments 27*a* which represents the length of her longest menstrual cycle is adjacent the base plate end segment 41*a*. The user can then read on the calendar disc 3*a* those days of the present menstrual cycle which are in registry with both zones of fertility 43*a* and 77 to see those days of possible fertility in the present month.

It is noted that even if the user has irregular menstrual cycles, if she can ascertain the day her basal temperature rises, she can determine that in the present menstrual cycle she has only approximately three days of fertility left, since ovulation occurs at a relatively fixed time with regard to the basal temperature use. It is further noted that even with irregular periods, ovulation normally occurs between the fourteenth and sixteenth day prior to the beginning of a female's next menstrual cycle and is not dependent on the length of the menstrual cycle.

It is to be understood that while certain embodiments of the present invention have been illustrated and described herein, it is not to be limited to the specific forms or arrangement of parts described and shown.

What is claimed and desired to secure by Letters Patent is:

1. A conception control calendar adapted for use by women having menstrual cycles of constant length for predicting probable periods of fertility; said calendar comprising:

(a) a first circular disc having equally sized segments of a first group spaced circumferentially about an outer edge thereof with each first group segment subtending an equal inner angle, said first group segments representing the days in two calendar months;

(b) a second circular disc having a plurality of equally sized segments of a second group disposed about an outer edge thereof; each of said second group segments subtending an angle equal to said inner angle; said second group segments representing days associated with a menstrual cycle of a user; and (c) a base plate having said first and said second discs concentrically and rotatably attached thereto; said base plate including an arcuate portion concentric with said first and second discs and having a plurality of segments of a third group thereon, said third group segments being registrable with said first and second group segments; said base plate having associated with one of said third group segments a menstrual cycle beginning marker and associated with other of said third group segments an ovulation indicator such that when a second group segments representing the number of days in the menstrual cycle of a user is placed in registry with a first group segment corresponding to the day that a next menstrual cycle of a user will start; and thereafter both said first second discs are simultaneously rotated relative to said base plate while remaining stationary relative to each other such that a second group segment corresponding to the number of days in the menstrual cycle of a user is placed in registry with said base plate menstrual cycle beginning marker, said base plate ovulation marker is in registry with first group segments corresponding to the period of expected ovulation in the present menstrual cycle of the user.

2. A calendar as set forth in claim 1 wherein:

(a) said base plate ovulation marker is substantially associated with the fourteenth, fifteenth, and sixteenth third group segments from said third group segment associated with said base plate menstrual cycle beginning marker.

3. A calendar as set forth in claim 1 wherein:

(a) said base plate includes indicia for indicating a fertility zone associated with and around said ovulation marker and being registrable with first group segments so as to indicate the period of possible fertilization of an ovum during a menstrual cycle of said user.

4. A calendar as set forth in claim 3 wherein:

(a) said fertility zone extends from the eleventh to the nineteenth third group segment from the base plate menstrual beginning marker.

5. A conception control calendar for predicting the possible days of ovulation in a menstrual cycle of a user who has successive menstrual cycles of varying lengths; said calendar comprising:

(a) a calendar member having a first set of equally sized segments apportioned thereon representing the calendar days of two months; each menstrual cycle having an associated segment of the first set segments representing the first day of such a menstrual cycle; said associated segment being variable for each cycle;

(b) a long menstrual cycle member having a second set of equally sized segments apportioned thereon representing the days of the longest known menstrual cycle of the user; one of said second set segments representing the first day of a menstrual cycle;

(c) a base plate having first and second spaced markers thereon; and (d) a short menstrual cycle member having first and second markers thereon spaced apart a distance equal to that of said base plate markers; said calendar member, said long and short menstrual cycle members and said base plate being registerable such that: when, cotemporaneously, said calendar member segment of said first set representing the day on which the present menstrual cycle of a user begins is placed in association with the long period menstrual cycle member segment of the second set representing the first day of a menstrual cycle; and said first marker of said short period menstrual cycle member is placed in association with a segment of said second set on said long cycle member representing the length of the shortest menstrual cycle of the user; and also thereafter said calendar member, said short cycle member and said long cycle member are simultaneously, and without movement relative to one another, positioned relative to said base plate so that a segment of said second set on said long menstrual cycle member representing the length of the longest menstrual cycle of the user is placed in registry with said base plate first marker; then, all of the segments of said first set on the calendar member which are in registry with either of said base plate second marker or said short menstrual cycle member second marker and also any segments of the second set therebetween indicate the possible days during the present menstrual cycle of the user in which ovulation might occur.

6. A calendar as set forth claim 5 wherein:

(a) said calendar member, said long menstrual cycle member, and said short menstrual cycle members each respectively comprise a disc concentrically retained on said base plate.

7. A calendar as set forth in claim 6 wherein:

(a) said base plate includes a segmented arcuate section defined thereon which is substantially concentric with said calendar member, said long menstrual cycle member and said short menstrual cycle member;

(b) said base plate and said short menstrual cycle member each have a plurality of equally sized segments of a third set and of a fourth set respectively between said respective first and second markers; and (c) said respective segments of said calendar member, said short menstrual cycle member, said long menstrual cycle member, and said base plate each subtend an equal inner angle.

8. A calendar as set forth in claim 7 wherein:

(a) said base plate second marker and said short menstrual cycle second marker each respectively extend over three of said respective segments.

9. A calendar as set forth in claim 8 wherein:

(a) said respective base plate and said short menstrual cycle member second markers extend between the fourteenth, fifteenth and sixteenth segment from said respective first marker inclusive thereof.

10. A calendar as set forth in claim 9 wherein:

(a) said base plate and said short menstrual cycle member include indicia associated with the respective second markers thereof to indicate periods of fertility respectively associated with the possible drawings of ovulation in each menstrual cycle; said indicia being registrable with segments of said first set to indicate a period of potential fertility along with days of probable ovulation for each menstrual cycle.

* * * * *